US006262686B1

(12) United States Patent
Delarminat et al.

(10) Patent No.: US 6,262,686 B1
(45) Date of Patent: Jul. 17, 2001

(54) ANTENNA INTENDED FOR A RADIO COMMUNICATION TRANSCEIVER

(75) Inventors: Alain Delarminat, Saumur; Laurent Mozer, Le Mans, both of (FR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/439,200

(22) Filed: Nov. 12, 1999

(30) Foreign Application Priority Data

Nov. 17, 1998 (FR) ..... 98 14412

(51) Int. Cl.[7] ..... H01Q 1/06
(52) U.S. Cl. ..... 343/721; 343/703; 343/894
(58) Field of Search ..... 343/721, 702, 343/895, 894, 703; H01Q 1/06

(56) References Cited

U.S. PATENT DOCUMENTS 2,473,981 * 6/1949 Wood ..... 240/8.1
5,917,453 6/1999 Uchino et al. ..... 343/721
5,969,694 * 10/1999 Harada et al. ..... 343/901

FOREIGN PATENT DOCUMENTS

0865098A1 9/1998 (EP) ..... H01Q/1/06

* cited by examiner

*Primary Examiner*—Don Wong
*Assistant Examiner*—Shih-Choo Chen
(74) *Attorney, Agent, or Firm*—Jack D. Slobod

(57) ABSTRACT

An antenna for installation in a radio communication device, namely a transmitter and/or receiver, has a substantially cylindrical exterior surface and includes at one end a light source which is a light-emitting diode encapsulated in a housing and electrical connection elements including rings disposed around the cylindrical surface, a light diffusing part at the other end, and an elongated light guide therebetween. The rings are in electrical contact with respective lighting contacts of the communication device when the antenna is installed in the communication device.

4 Claims, 3 Drawing Sheets

ANTENNA INTENDED FOR A RADIO COMMUNICATION TRANSCEIVER

BACKGROUND OF THE INVENTION

1. Field of the Invention

The present invention relates to an antenna intended for a radio communication transmitter and/or receiver, which antenna has the appearance of a rod and comprises a light source, a light path and a light diffusing part.

2. Description of the Related Art

The invention also relates to a radio communication transmitter and/or receiver intended to be equipped with an antenna.

An antenna as defined in the opening paragraph above is known from document EP 98 200 315.4. According to this document, an antenna in the form of a rod has a light source and comprises a light path and a light diffusing part, while the light source is situated outside the antenna.

OBJECT AND SUMMARY OF THE INVENTION

It is an object of the invention to facilitate the mounting of the antenna, notably when the latter is sold as an accessory to be mounted by the user.

For this purpose, the light source is a light-emitting diode encapsulated in a housing and having connections, this housing being attached to the antenna facing the light path, and the connections of the diode being arranged such as to enable an electrical contact with electrical conductors of the receiver when the antenna is put in place in the receiver.

A radio communication transmitter and/or receiver according to the invention comprises, on the one hand, signal contacts intended to be put into contact with receiving elements for receiving signals from the antenna and, on the other hand, lighting contacts intended to be put into contact with the contacts of the light emitting diode when the antenna is put in place in the receiver.

An apparatus equipped with an ordinary non-luminescent antenna may thus have contacts for a luminescent antenna at marginal cost, which enable installation of such an antenna as an option and by the user himself.

These and other aspects are apparent from and will be elucidated, by way of non-limitative example, with reference to the embodiment(s) described hereinafter.

In the drawings:

DETAILED DESCRIPTION OF THE PREFERRED EMBODIMENTS

Figure 1:
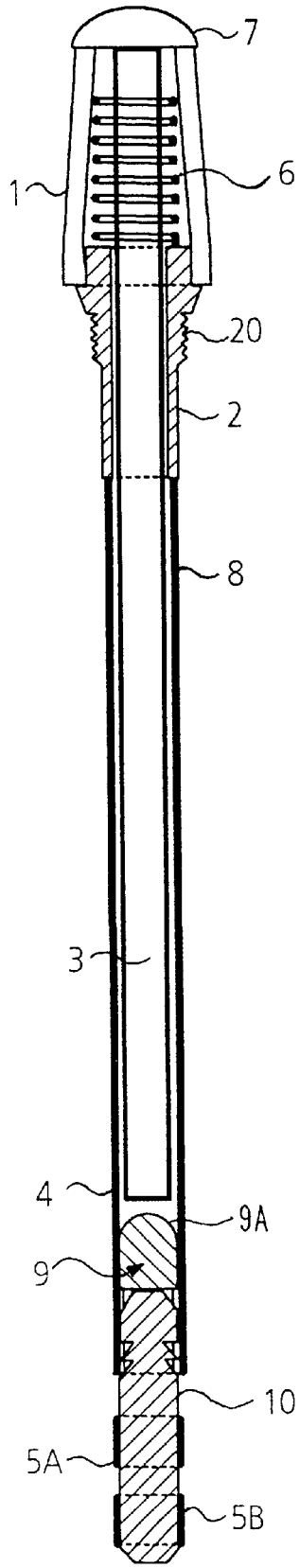
FIG. 1 represents a complete antenna in a cross-sectional view.

The antenna represented in FIG. 1 has the appearance of a rod and comprises a light source 9 and a light guide 3. This guide is, for example, a solid tube of transparent plastic material, for example, of methacrylate.

The upper end of the light guide 3 is placed facing a head formed here by an assembly comprising a stopper 7 and a sleeve 1, the two of them made of translucent or opalescent material which emits to the outside the light received from the light guide. Inside the sleeve 1, the signal receiving elements comprise by a helical electrical part formed by a metallic spring 6 which surrounds the light guide. A sheath 2 made of electrical conducting material is connected to the electrical part 6 of the antenna and ensures an electrical link with a circuit of a radio communication transceiver, for example a mobile telephone. This sheath comprises a threaded part 20 to screw the antenna in place into a radio communication device.

The light source is a light-emitting diode encapsulated in a housing 9A. This housing 9A is placed facing the light guide, of course with a light-emitting surface turned towards the guide 3. Housing 9A is attached to a support pin 10 which itself is attached to the antenna by means of a body 8 in the form of a tube that surrounds and protects the light guide and gives support to the pin 10. Connection rings 5A, 5B completely surround the pin 10 and are each connected to a different one of the electrodes of the diode. When the antenna is screwed into place in the receiver, the rings enable an electrical contact with electrical conductors of the transceiver, whatever the rotational position of the body 8.

Figure 2:
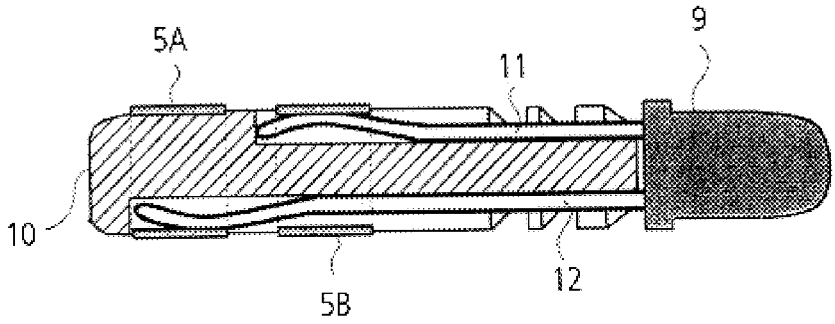
FIG. 2 represents in a cross-sectional view and on a larger scale the element that comprises the diode and its contacts.
Figure 3:
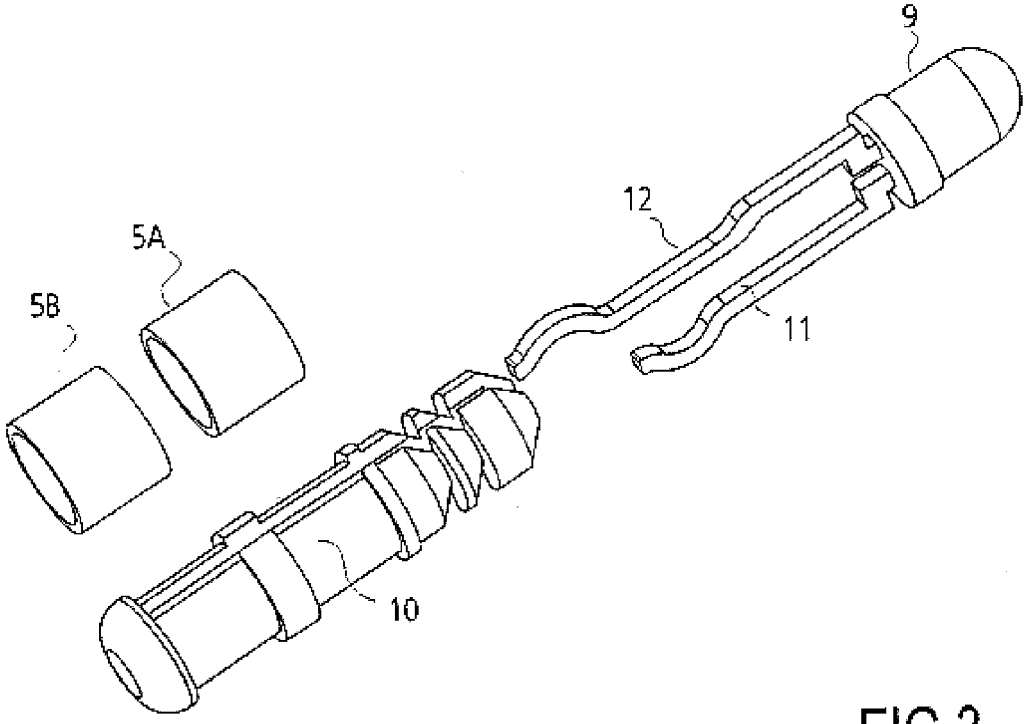
FIG. 3 represents in a perspective and exploded view the element that comprises the diode and its contacts.

The element that comprises the diode and its electrical connection elements is represented in more detail by FIGS. 2 and 3. The diode 9, for example, in a standardized housing of the type SOD53F, has two connection elements 11 and 12 which are formed with a curved part at their end, on the left in the Figures. The body 10 has two longitudinal grooves for receiving the connection elements 11 and 12. The two rings 5A and SB are in electrical contact with the curved part of the connection elements 11 and 12, respectively.

Figure 4:
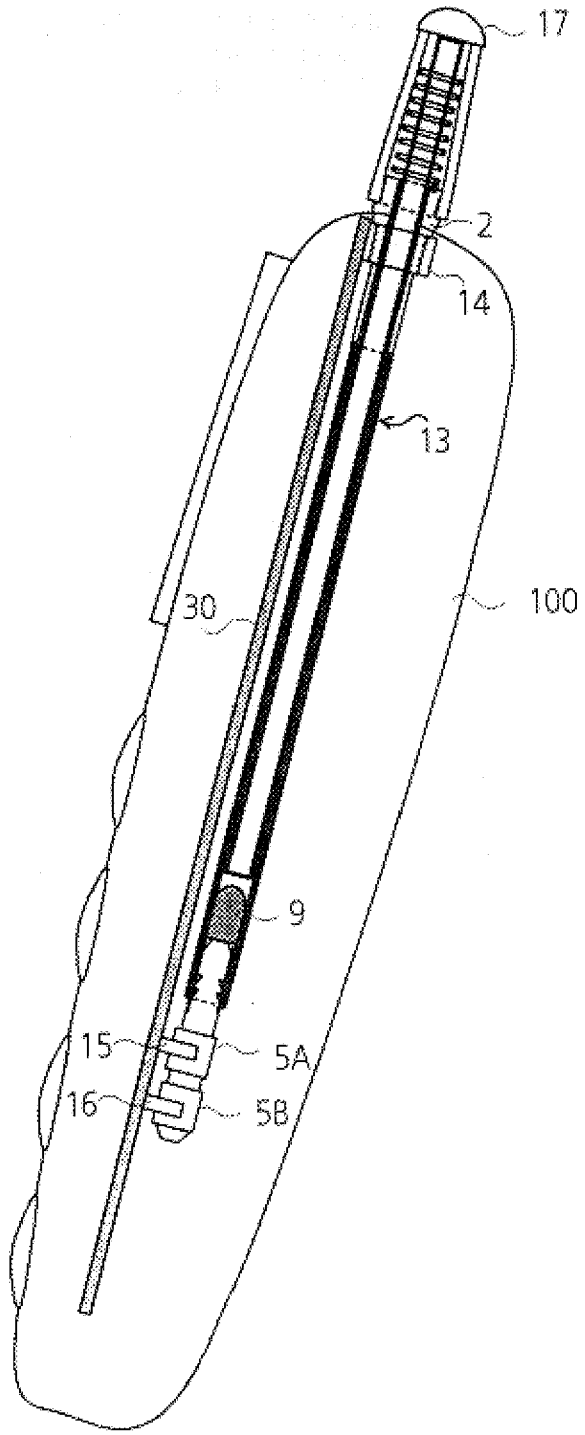
FIG. 4 represents a radio communication transceiver in a transparent view, with an antenna.

The radio communication transceiver represented in FIG. 4, here a mobile telephone, comprises a removable antenna 13 that has an outside end 17 that includes means for emitting light, and signal receiving or transmitting means that include a part 2 for conducting radio signal. At the other end of the antenna, a light-emitting diode 9 is mounted whose electrical connections are connected to connection rings 5A, 5B. The telephone comprises an electric circuit realized on a printed circuit 30 to which are connected, on the one hand, a signal contact 14, here a ring with a threaded hole for receiving externally threaded part 20 (FIG. 1) of the antenna therein, that is to say, the part connected to the signal receiving elements and, on the other hand, lighting contacts 15, 16 which are put into contact with the contacts 5A, 5B of the diode when the antenna is installed in place in the transceiver, which is the case here.

What is claimed is:

1. An antenna for installation in a radio communication device, which antenna has a substantially cylindrical exterior surface and comprises a light source, an elongated light guide and a light diffusing part, wherein the light source is a light-emitting diode encapsulated in a housing and having electrical connection elements, said housing being attached to the antenna facing an end of the light guide, and the electrical connection elements of the diode comprising contact areas which are arranged along a part of said cylindrical surface such as to enable an electrical contact with lighting contacts of the communication device when the antenna is installed in the communication device.

2. The antenna as claimed in claim 1, wherein the contact areas of the diode are rings disposed around the cylindrical surface.

3. The antenna as claimed in claim 1, which is formed by three parts, a head with radio signal receiving or transmitting elements and a transparent or translucent cap, a body which contains and protects the light guide, and an element that comprises the diode and the electrical connection elements of the diode.

4. A radio communication device intended to have installed therein the antenna as claimed in claim 1, which communication device comprises, on the one hand, radio signal contacts which are put into electrical contact with connection elements of the antenna for conveying radio signals to or from the antenna and, on the other hand, lighting contacts which are put into electrical contact with the connection elements of the light-emitting diode, when the antenna is installed in the radio communication device.

* * * * *